United States Patent [19]

Schleupen

[11] 4,391,262

[45] Jul. 5, 1983

[54] IGNITION SYSTEM FOR AN INTERNAL COMBUSTION ENGINE

[75] Inventor: Richard Schleupen, Ingersheim, Fed. Rep. of Germany

[73] Assignee: Robert Bosch GmbH, Stuttgart, Fed. Rep. of Germany

[21] Appl. No.: 313,358

[22] Filed: Oct. 20, 1981

[30] Foreign Application Priority Data

Oct. 28, 1980 [DE] Fed. Rep. of Germany ..... 3040509

[51] Int. Cl.[3] ..... F02P 1/00

[52] U.S. Cl. ..... 123/618; 123/609

[58] Field of Search ..... 123/414, 418, 599, 602, 123/609, 611, 614, 617, 618, 644, 651

[56] References Cited

U.S. PATENT DOCUMENTS

| | | | |
|---|---|---|---|
| 4,019,484 | 4/1977 | Mori | 123/611 |
| 4,086,895 | 5/1978 | Habert | 123/609 |
| 4,176,645 | 12/1979 | Jundt et al. | 123/609 X |
| 4,328,439 | 5/1982 | Adler et al. | 123/617 X |
| 4,356,808 | 11/1982 | Bodig et al. | 123/618 X |

*Primary Examiner*—Tony M. Argenbright

*Attorney, Agent, or Firm*—Frishauf, Holtz, Goodman & Woodward

[57] ABSTRACT

To provide sufficient ON-time to store adequate electromagnetic energy in an ignition coil (5, 6), even under high-speed engine operations, in which the ON time of an electronic ignition breaker switch (7, 8) and the OFF or ignition instant thereof is determined by a signal (U16) derived from an a-c type signal source, a signal processing stage (32) is interconnected between the signal source and the ignition signal triggering stage (9) which includes an integrator (27) which commences to integrate when, after an ignition event, the voltage from the signal source (16) has dropped to a predetermined level (Up), the integrated voltage being compared with a threshold level (Uc) to start the ON period of the switch (7, 8) even though the voltage from the signal source (16) may be below that reference level (Up), the output from the integrator and from the signal source being connected to an analog OR-gate (21, 30, 31, 33) which passes the higher one of the two signals, the integrator (27) thereupon being reset to permit commencing of integration upon the next cycle when the generator output voltage (U16) has again passed through the reference level (Up).

8 Claims, 2 Drawing Figures

IGNITION SYSTEM FOR AN INTERNAL COMBUSTION ENGINE

Figure 1:
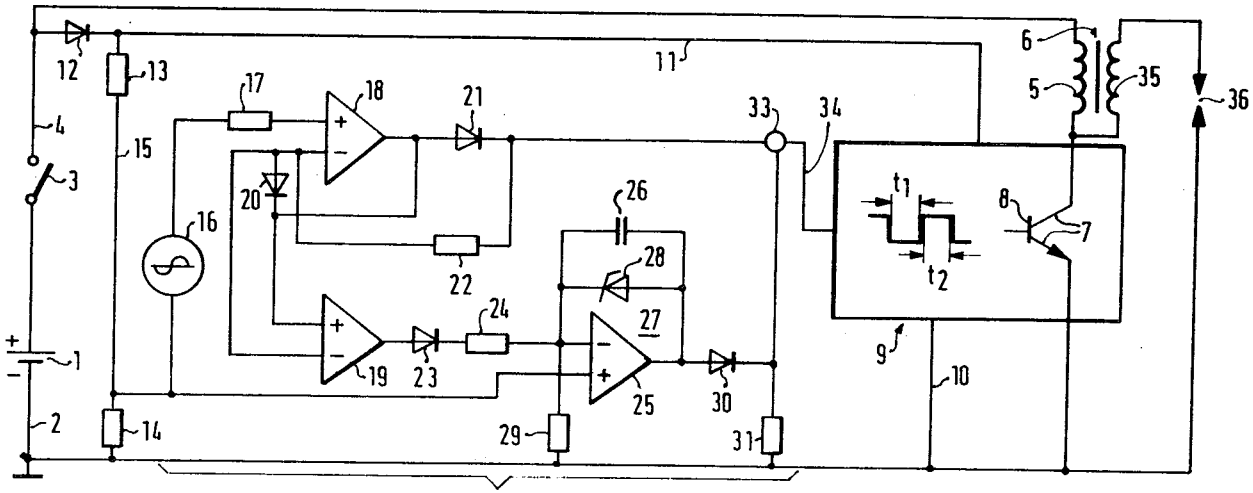

Reference to related patents, assigned to the assignee of this application:

U.S. Pat. No. 4,176,645, Dec. 4, 1979, Jundt et al., U.S. Pat. No. 4,328,439, May 4, 1982, Adler et al.

The present invention relates to an ignition system for an internal combustion engine, and more particularly to an ignition system of the type generally described in U.S. Pat. No. 4,176,645, Jundt et al., asigned to the assignee of the present application.

BACKGROUND

The aforementioned U.S. patent describes an ignition system in which one flank, typically the rising flank, of an ignition control signal determines the ON time of a switch controlling current flow through an ignition coil, and the trailing flank the OFF time instants, when ignition is to occur. This system works very well; it has been found, however, that variations in control signals derived from various types of transducers cause changes in the design values of the dwell angle of current flow, that is, the duration between ON time and OFF time of current flow through the coil. Further, at extremely high-speed operation, the control of the ON time instant becomes difficult due to the rapid sequence of ON and OFF control pulses. Stray pulses, or stray and undesired wave shapes derived from an inductive signal transducer also interfere under some operating conditions, particularly under high-speed operation, with operation of the system in accordance with design requirements.

THE INVENTION

It is an object to improve the ignition system described in the aforementioned U.S. Pat. No. 4,176,645 by rendering it essentially immune to signal deviations from a desired signal, as furnished by an ignition transducer, and to facilitate maintenance of current flow for a sufficient dwell angle even under extremely high-speed engine operation.

Briefly, a signal processing stage is provided which includes an integrator to derive a control signal portion which occurs in advance of the peak value of the signals derived from the transducer. This control signal portion, generated by the integrator, has an at least approximately uniform changing rate in a rising direction, and occurs during the time when the transducer signal has reverse polarity; this signal is then combined with the transducer signal after the transducer signal has changed sign, and the slope thereof has changed. The combined signal, thus, will be for a first part the control signal portion derived from the integrator, and for a second part the signal derived from the transducer up to a peak value. As the transducer signal then drops from the peak, the OFF-threshold will be passed, generating a triggering signal. Looked at from a voltage-time diagram, thus, the differential of the control signal portion forming the first part, and the transducer signal below the peak value thereof will be of the same sign, that is, the slope does not reverse.

The system has the advantage that noise or stray pulses are effectively eliminated, ignition pulses which might be generated due to reversal of the signal derived from the transducer as a consequence of noise or stray influences are effectively suppressed, and, further, the ON-time of current flow through the ignition coil will be sufficiently even at high-speed operation to provide sufficient ignition energy to the coil, since ignition energy can be controlled to flow to the coil during that portion of the output signal which still forms part of the trailing flank of the signal from the generator, during which time, however, the integrated control signal portion already is being generated.

In accordance with a preferred embodiment, the integrator receives an input from a signal source, generating the ignition signals, which are in form of a-c signals similar to those derived from an a-c generator. The signal from the integrator is then combined with the signal from the a-c generator in a circuit which is responsive to the larger one of the values, so that either the control signal portion from the integrator or the signal portion from the transducer generator—whichever is larger—is available for evaluation to determine the ON instant of time of current flow through the ignition coil and, of course, also the OFF instant after the peak value of the output signal from the transducer has passed.

DRAWINGS

FIG. 1 is a highly schematic diagram of the ignition system, omitting all components and elements which are not necessary for an understanding of the invention; a complete ignition system is shown and described in the referenced U.S. Pat. No. 4,176,645; and FIG. 2 is a voltage (ordinate)-time (abscissa) diagram used in connection with explanation of the operation of the system.

The ignition system can be used, for example, with an externally ignited Otto-type internal combustion (IC) engine, for example of the vehicular, particularly automotive type. Such an ignition system is supplied with electrical power from a battery 1 which, typically, is a battery of the vehicle. The negative terminal of the source 1 is connected to a chassis or ground bus 2; the positive terminal is connected through a main switch 3 to a positive bus 4. The positive bus 4 is connected through the primary winding 5 of an ignition coil 6 to an electrical interrupter or breaker 7 which, in the example shown, is the collector-emitter path of a switching transistor 8, the collector being connected to the ignition coil 6, and the emitter to the chassis bus 2. The transistor 8 forms a component of an electronic switching unit 9 which, for example, can be constructed as described in the aforementioned referenced U.S. Pat. No. 4,176,645, Jundt et al. The unit 9 controls the electronic breaker switch 7 during a time period t1—see FIG. 1—to block, and during a time period t2 to open. The time periods t1, t2 are controlled in dependence on engine or vehicle operating parameters, primarily and preferably based on speed of the IC engine. The time periods are so changed that the ignition coil 6 will store only so much magnetic energy as is necessary to provide an effective spark at a spark plug 36. Since the coil can saturate, excessive current flow therethrough should be avoided. The unit 9 is connected to chassis over line 10 and supplied with energy from a bus 11 which is connected through a reverse-polarity protective diode 12 to the bus 4. A voltage divider formed of resistors 13, 14 is connected across bus 11, which is connected to the cathode of diode 12. The voltage divider 13, 14 is so dimensioned that the common junction or tap point 15 thereof is approximately midway in voltage level between that of the terminal points of the resistors 13, 14, that is, about half the voltage of source 1. The common junction 15 is connected to a transducer 16 which operates similarly to an a-c generator to generate an ignition control signal which will, after suitable processing, trigger ignition of the spark plug 36. The terminal of the transducer 16, remote from junction 15, is connected through a coupling and current offset compensation resistor 17 to the direct input of an operational amplifier 18. The inverting input of the operational amplifier 18 is connected to the inverting input of a further operational amplifier 19. The direct input of operational amplifier 19 is connected to the output of operational amplifier 18 and to the cathode of a diode 20, the anode of which is connected to the inverting input of the operational amplifier 18. The output of operational amplifier 18 is connected to the anode of a diode 21, the cathode of which is connected over a current limiting resistor 22 with the inverting input of the operational amplifier 18. The output of operational amplifier 19 is connected to the anode of a blocking diode 23, the cathode of which is connected over a current limiting resistor 24 to the inverting input of an operational amplifier 25. The third operational amplifier 25, together with capacitor 26, forms an integrator 27. Capacitor 26 is connected between the inverting input of operational amplifier 25 and its output. Operational amplifier 25 further has a Zener diode 28 connected between the inverting input thereof and its output, poled as shown. The inverting input of the third operational amplifier 25 is further connected through a resistor 29 with the ground or chassis bus 2. The direct input of operational amplifier 25 is connected to the common junction 15 of the voltage divider resistors 13, 14.

The output of operational amplifier 25 is connected to the anode of a blocking diode 30, the cathode of which is connected through resistor 31 to chassis bus 2. The first, second and third operational amplifiers 18, 19, 25, together with the associated network elements, form a signal processing stage having as its input the signal source formed by transducer 16 and having an output 33 from which, respectively, the voltage U16 of the transducer 16, and the voltage U27 of the integrator 27 is available which, with reference to a comparison level, Up, has the higher instantaneous value. In a preferred case, a "highest-wins" or maximum value detection circuit can be used. The output 33 of the signal processing stage thus is a voltage U33.

Figure 2:
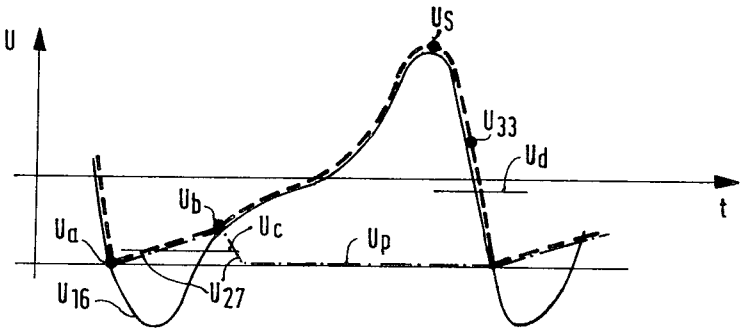

Voltage U33 is shown in FIG. 2 in broken lines; voltage U16 of the signal source 16 is shown in full lines, and voltage U27 of integrator 27 is shown in chain-dotted line. The portion of the curve in advance of the peak value Us, that is, the portion Ub-Us, forms a continuation of an initial portion Ua-Ub. The slopes of the curves, that is, the sign of the rates of change of the signals, does not change. Mathematically expressed, the differential of the curve portions Ua-Ub and Ub-Us will have the same sign.

FIG. 2 further shows the switching thresholds of the stage 9; Uc is the ON threshold of stage 9. This means that, when the voltage U33 at terminal 33 of the signal processing stage 32 reaches the level Uc, the electronic breaker switch 7 will close, that is, current can flow from bus 4 through primary winding 5 of coil 6 to the chassis bus 2. The OFF threshold is shown at Ud, which means that, when after the peak value and reversal of the sign of the differential, the voltage again drops and crosses the threshold Ud, stage 9 will control switch 7 to open, that is, cause the transistor 8 to block. The output terminal 33, thus, is connected to the input line 34 of stage 9, and to the junction of the cathode of diode 30 and resistor 31, as well as with the cathode of the diode 21. Junction 33, thus, functions like an analog OR-gate, in which the respectively highest value of applied signals is passed.

The secondary winding 35 of ignition coil 6 is connected to a spark plug 36, in customary manner, across coil 35 and ground or chassis.

Operation: Upon closing of the operating switch 3, the ignition system will be ready for use. Let it be assumed that time period t1 has just started. Consequently, the switch 7 is brought into open or blocked condition, and current through the primary winding 5 of coil 6 has just been interrupted, causing a spark at spark plug 36.

The voltage of the transducer or a-c source 16 decreases and goes in the direction of the value Ua, see FIG. 2. The output voltage U33 at the output 33 of the processing stage 32 coincides with the voltage U16, since the operational amplifier 18 will operate as a voltage follower. Until the voltage value Ua is reached, the voltage drop on the diode 21 of operational amplifier 19 will be such that the output of the operational amplifier 19 is positive. The output value of the operational amplifier signal 19 is so selected that the breakdown of the Zener diode 28 is exceeded, and the output value on operational amplifier 25 is shifted to the value Up.

As the voltage U16 of the signal source 16 reaches the value Ua, the voltage across the diode will disappear, and the operational amplifier 19 will no longer receive any input, so that its output will switch to a negative value. This causes the Zener diode 28 to block, since its threshold will be passed in a negative direction. Capacitor 26 will recharge in opposite polarity, gradually, to provide at the output of operational amplifier 25 a gradually rising signal which will rise linearly. The voltage available from operational amplifier 25 thus will rise linearly, and will be applied to the output 33 of the signal processing stage 32 as voltage U27. The integration on integrator 27 will continue until the voltage U16 of the signal source 16 reaches the value Ub, that is, the same value as that of the integrated output from operational amplifier 25. When the voltage U16 exceeds that of the integrator 27, that larger value of the voltage will be available at the output 33. The voltage drop across diode 21 will then rise again, so that the output of operational amplifier 19 will become positive, the threshold of the Zener diode 28 will again be exceeded, and the operational amplifier 25 will have its output again drop to the value Up. The voltage U33 at the output of the stage 32 will again coincide with the voltage U16 of the signal source 16 until the voltage Ua again is reached, at which time the voltage from the output of operational amplifier 25, starting at the value Up, will take over and appear at the output terminal 33, that is, the cycle will repeat. Before the value Ua has again been reached, and on the trailing flank of the curve, the voltage has passed the OFF threshold Ud, thus initiating another ignition event, as described above.

It can be seen that at high engine speeds current will flow through the primary 6 of the ignition coil for a longer period of time than that which would be controlled by the intersection of the threshold Uc with the curve U16. Thus, the period of time that current flows through ignition coil 16 will be longer by using the present invention than without it, at high engine speeds. This can readily be seen by comparing the intersections of the curves U16 and U33, that is, the solid line and broken line, respectively, with the threshold level Uc. Additionally, feedback due to the presence of the signal source 16 itself, and non-linearities therein which may cause disturbances and undesired ignition timing are effectively suppressed.

The signal processing stage 32, of course, can be integrated with stage 9, and the separate showing is intended only for better illustration and clarity.

Various changes and modifications may be made within the scope of the inventive concept.

I claim:

1. Ignition system for an internal combustion engine having means (16) operating similarly to an a-c generator for generating an ignition signal (U16);

an ignition coil (5, 6);

a controlled switch (7, 8) controlling current flow through the ignition coil;

and a signal processing stage (32, 9) interconnecting the signal generating means (16) and the controlled switch (7, 8) for rendering the controlled switch conductive, to store electromagnetic energy in the coil, at an instant of time during which the ignition signal changes in value in a first predetermined direction, and rendering the controlled switch non-conductive, and hence interrupting current flow through the coil and cause a high-voltage ignition pulse to appear thereacross, at an instant of time during which the ignition signal changes values, and in opposite direction, wherein, in accordance with the invention, the signal processing stage includes means (32) deriving a first control signal portion (Ua-Ub) occurring in advance of the peak value of the ignition signal, and having an at least approximately uniformly changing rate in said first direction during at least part of the time when the ignition signal changes level or value in the opposite direction;

and means (33) combining said first control signal portion and the ignition signal at a time (Ub) when both the ignition signal and the first portion of the control signal are changing in said first direction, and said ignition signal is at a level below its peak value (Us), so that the differential, in a voltage-time diagram of the control signal portion (Ua-Ub) and the ignition signal portion below the peak thereof (Ub-Us) will have the same sign.

2. System according to claim 1, wherein said first direction is the rising portion or flank of the ignition signal.

3. System according to claim 1, wherein said control signal portion deriving means comprises an integrator (27), and said combining means comprises means (21, 30, 31, 33) passing the higher of said first control signal portion or said command signal portion.

4. System according to claim 3, wherein the integrator has its input connected to and controlled by the output from said ignition signal generating means (16) and its output applied to said combining means.

5. System according to claim 1, wherein said means deriving the first control signal portion (Ua-Ub) comprises an integrator (16), said portion being formed by a voltage derived from said integrator.

6. System according to claim 1, wherein said combining means comprises an analog OR-gate responsive to and passing the highest one of signals applied thereto.

7. System according to claim 6, wherein the integrator (27) comprises means (19, 21, 28) responsive to the voltage level of the ignition signal generating means and to the output level of the integrator, and resetting the integrator when the voltage level of the ignition signal generating means and of the integrator have a predetermined relationship.

8. System according to claim 7, wherein said predetermined relationship is, at least approximately, signal level equality.

* * * * *